US005467716A

United States Patent [19]

Boual

[11] Patent Number: 5,467,716

[45] Date of Patent: Nov. 21, 1995

[54] TELESCOPED-TYPE MUNITION

[75] Inventor: Roland Boual, Saint German du Puy, France

[73] Assignee: Giat Industries, Versailles, France

[21] Appl. No.: 318,725

[22] PCT Filed: Mar. 8, 1994

[86] PCT No.: PCT/FR94/00252

§ 371 Date: Oct. 13, 1994

§ 102(e) Date: Oct. 13, 1994

[87] PCT Pub. No.: WO94/20813

PCT Pub. Date: Sep. 15, 1994

[30] Foreign Application Priority Data

Mar. 12, 1993 [FR] France ..... 93 02896

[51] Int. Cl.[6] ..... F42B 5/045

[52] U.S. Cl. ..... 102/434; 102/430; 102/439

[58] Field of Search ..... 102/430, 433, 102/434, 439, 462–468

[56] References Cited

U.S. PATENT DOCUMENTS

| | | | |
|---|---|---|---|
| 2,996,988 | 8/1961 | Kunz | 102/433 |
| 2,996,998 | 8/1961 | Gold et al. . | |
| 3,272,982 | 12/1993 | Desevaux | 102/434 |
| 3,482,516 | 12/1969 | Farmer et al. . | |
| 3,897,729 | 8/1975 | Schirneker | 102/430 |
| 4,770,098 | 9/1988 | Stoner . | |
| 5,069,137 | 12/1991 | Martwick | 102/434 |
| 5,173,571 | 12/1992 | Montgomery | 102/434 |
| 5,192,829 | 3/1993 | Suire | 102/434 |
| 5,265,540 | 11/1993 | Ducros et al. . | |

FOREIGN PATENT DOCUMENTS

| | | |
|---|---|---|
| 1571251 | 6/1969 | France . |
| 2647890 | 12/1990 | France . |
| 2679991 | 2/1993 | France . |
| 2679994 | 2/1993 | France . |
| 1919954 | 2/1972 | Germany . |
| 1310607 | 3/1973 | United Kingdom . |

*Primary Examiner*—Harold J. Tudor
*Attorney, Agent, or Firm*—Oliff & Berridge

[57] ABSTRACT

A munition includes a casing having a cylindrical envelope blocked at each end by a plug. A projectile and a propelling charge are placed in the casing. The munition also includes structure to ensure the axial hold of the projectile with respect to the envelope. The structure includes a cap integral with a front part of the projectile and made integral with the front plug by a fastener.

14 Claims, 3 Drawing Sheets

TELESCOPED-TYPE MUNITION

BACKGROUND OF THE INVENTION

The scope of the present invention is that of telescoped-type munitions.

These munitions usually comprise a casing composed of a cylindrical tube, having a plug at each end, in which a projectile and propelling charge are placed.

The projectile is entirely enclosed by the casing and means to ensure that it is held in its position, axially and radially, with respect to the casing envelope must be provided.

Patent FR2679991 describes different means enabling the projectile to be held axially with respect to the envelope.

These means can comprise a rear stop carried by a primer and a front stop constituted by an elastic ring placed in a groove of the front plug.

There are several disadvantages to this solution.

When the munition is being fired the front and back plugs move with respect to the envelope with the danger of causing the projectile to tilt thereby impeding the correct loading of the projectile in the gun barrel.

Document FR2679991 describes other holding means which combine a stop surface fitted on the front plug and an elastic ring placed in a groove in the same plug.

The problem wherein the projectile tilts when the plugs move is thereby avoided.

However, firing tests have demonstrated that the use of an elastic ring was causing disturbances in the projectile.

In fact such rings are usually fitted with a slit enabling them to be inserted into a groove and this slit constitutes an asymmetric band on the ring.

When the projectile is fired the ring does not fracture symmetrically because of its slit. This causes a shock to the projectile which does not follow the axial direction of the latter.

Such a shock disrupts loading in the gun barrel and the later ballistic reaction of the projectile.

SUMMARY OF THE INVENTION

One object of the invention is to provide a telescoped munition comprising axial holding means for the projectile which provide an efficient holding capacity as well as ensuring the smooth release of the projectile upon firing.

These holding means are also of a simple form and enable the projectile to be easily inserted into the casing.

According to one object of the invention there is provided a telescoped-type munition comprising a casing, composed of a cylindrical tube blocked at each end by a plug, in which a projectile and a propelling charge are placed, a munition comprising structure to ensure that the projectile is held in place axially with respect to the envelope, a munition characterized in that the axial holding structure comprises a cap composed of a cylindrical central part integral with a front part of the projectile and fitted with a ring-shaped collar which is made integral with the front plug by fastening means.

According to another characteristic, the ring-shaped collar serves to seal the front of the envelope.

According to a first variant, the fastening means are composed of the welding of the collar onto the front plug.

According to a second variant, the front plug is fitted with a metal reinforcing ring and the fastening structure is composed of the pinching of the collar between the ring and the front plug.

In one preferred embodiment, the cylindrical central part of the cap is fitted with axial slits evenly distributed at an angle as well as corner-shaped segments fitted to one end and designed to be housed in a groove of the projectile as to make the cap integral with the projectile.

According to another characteristic of the invention, the ring-shaped collar is provided with the starting point of a fracture.

This fracture starting point may be a thinning around the collar, wherein the diameter is roughly equal to that of the cylindrical central part of the cap.

In the event that the projectile comprises a sub-caliber shaft placed in the boring of a sabot to caliber, the cap can be made integral with a front part of the sabot on a level with the boring.

In the event that the projectile is fitted with an ogive on its front part whereon is fixed a nose cone comprising a cylindrical outer profile enabling it to be fitted into the front ring, the nose cone can also be fitted with a boring whereby the cap can be made integral with the projectile.

BRIEF DESCRIPTION OF THE DRAWINGS

The invention will be better understood after reading the following description made in reference to the drawings in which:

FIGS. 2*a* and 2*b* represent the holding cap of the projectile according to two mutually perpendicular views, wherein FIG. 2*b* is a cross-section following the plane II—II shown on FIG. 2*a*, FIGS. 5*a* and 5*b* represent the holding cap of the projectile according to two mutually perpendicular views, wherein FIG. 5*b* is a cross-section following plane V—V shown on FIG. 5*a*, FIGS. 8*a* and 8*b* represent the holding cap of the projectile according to two mutually perpendicular views, wherein FIG. 8*a* is a cross-section following the plane VIII—VIII shown on FIG. 8*a*.

DETAILED DESCRIPTION OF PREFERRED EMBODIMENTS

Figure 1:
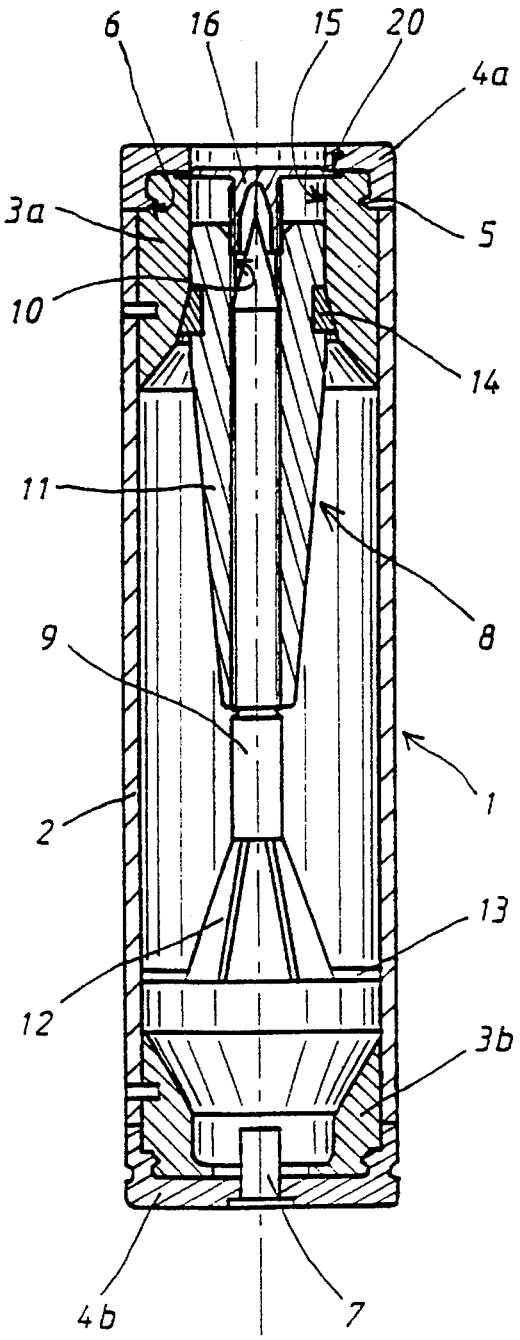
FIG. 1 represents a cross-section of a munition according to the invention wherein the projectile is of the sub-caliber type.

Referring to FIG. 1, a munition 1 according to the invention comprises a casing, composed of a cylindrical envelope 2 blocked by a front plug 3*a* and a rear plug 3*b*.

The plugs are made of plastic material and are provided with metal reinforcing means.

The front plug 3*a* is fitted with a reinforcing ring 4*a* and the rear plug 3*b* is fitted with a reinforcing plate 4*b*.

The ring 4a is fitted with a ring-shaped rim 5 which is squeezed into a peripheral groove 6 on the plug 3a.

The plate 4b is fixed in a similar way onto the rear plug 3b. It carries a primer 7 of the type described in patent FR2679994.

A projectile 8 and propelling charge (not represented) are placed in the casing.

In this first embodiment of the invention, the projectile 8 comprises a sub-caliber shaft 9 placed in a threaded bore 10 in a sabot 11 to caliber.

In a known way, the sabot 11 comprises several segments designed to hold the shaft during firing and then release it upon exiting the gun barrel.

The shaft comprises threading which enables it to be made integral with the sabot by means of the boring 10.

The shaft 9 is fitted with a fin 12 to its rear end upon which a wedge 13 is fastened. The wedge 13 ensures the radial hold of the projectile with respect to the envelope 2 as well as providing guiding means for the projectile relative to the envelope.

The sabot has a belt 14 on its front part which fits in an axial boring 15 of the front plug 3a. In a known way the belt is designed to provide sealing means between the projectile and the gun barrel.

Such a projectile is described in detail in patent FR2,647,891.

The axial hold of the projectile 8 with respect to the envelope 2 is ensured by means of a cap 16 integral with the sabot 11 of the projectile.

Figure 2A:
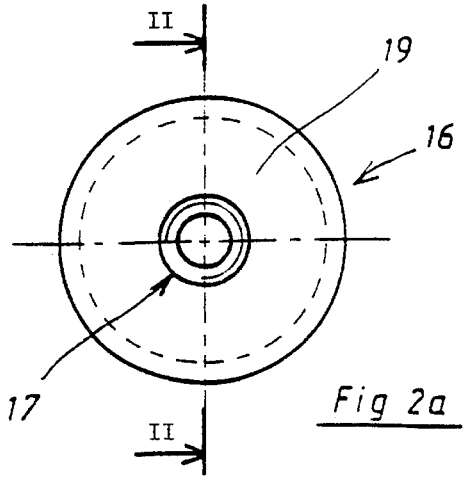
Figure 2B:
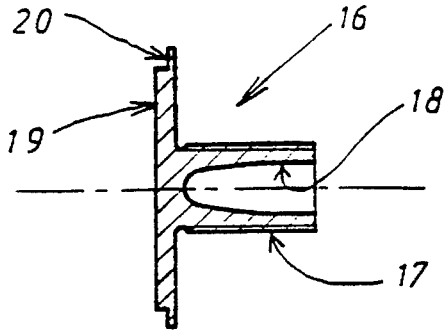

The cap 16 is represented in detail in FIGS. 2a and 2b. It comprises a cylindrical central part 17 wherein the diameter is roughly equal to that of the boring 10.

This central part comprises threading which enables the cap 16 to be made integral with the projectile sabot by means of the boring 10.

It comprises in internal hollow section 18 which can house the end of the shaft 9.

The cap also comprises a ring-shaped collar 19 which is designed to be made integral with the plug 3a by fastening means.

According to the particular embodiment here described, the fastening means comprise the pinching of the collar 19 between the ring 4a and the front plug 3a.

The part of the collar 19 being pinched is a thinned off edge 20 which also constitutes a fracture starting point for the collar 19.

Because it is symmetrical with respect to the axis of the munition, the edge 20 fractures when the munition is fired without causing a non-axial shock to the projectile.

The collar 19 also acts as an inner lid for the munition and prevents outside humidity from entering the casing.

The cap in itself ensures the axial hold of the projectile with respect to the front plug 3a. It is therefore not necessary to provide a flange for the plug 3a or a rear stop for the projectile.

Such an arrangement has the further advantage of ensuring the axial immobilization of the projectile without prolonging the compression of the belt material 14 against the plug 3a. The aging stability of the munition is thereby improved.

The munition is assembled as follows:

the front plug 3a, the ring 4a and the cap 16 are made integral, the fully assembled projectile 8 is screwed onto the cap 16, the plug 3a fitted with the projectile is positioned on the envelope 2, the plug 3a and the envelope 2 are made integral, for example by means of radial pins, the casing is filled with the propelling charge, the rear plug 3b carrying the primer is fastened on, the plug 3b and the envelope 2 are made integral, for example by means of radial pins.

As a variant the cap may be fastened by means of ultrasonic welding or alternatively by sticking to the material of the front plug.

Figure 3:
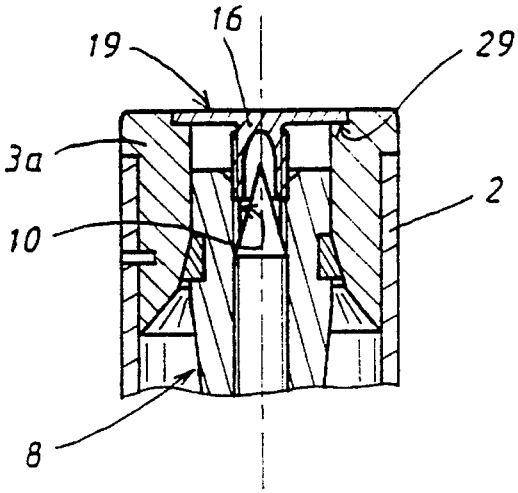
FIG. 3 represents a variant in the embodiment of this munition.

FIG. 3 shows in detail the front part of a munition assembled according to such a variant.

The front plug 3a has a counter-sink 29 wherein the collar 19 of the cap 16 is housed.

The cap is fastened to the front plug 3a by the ultrasonic welding at the countersink 29.

The cap is fastened to the projectile 8 by screwing the threaded cylindrical part 17 into a boring 10 of the sabot.

Figure 4:
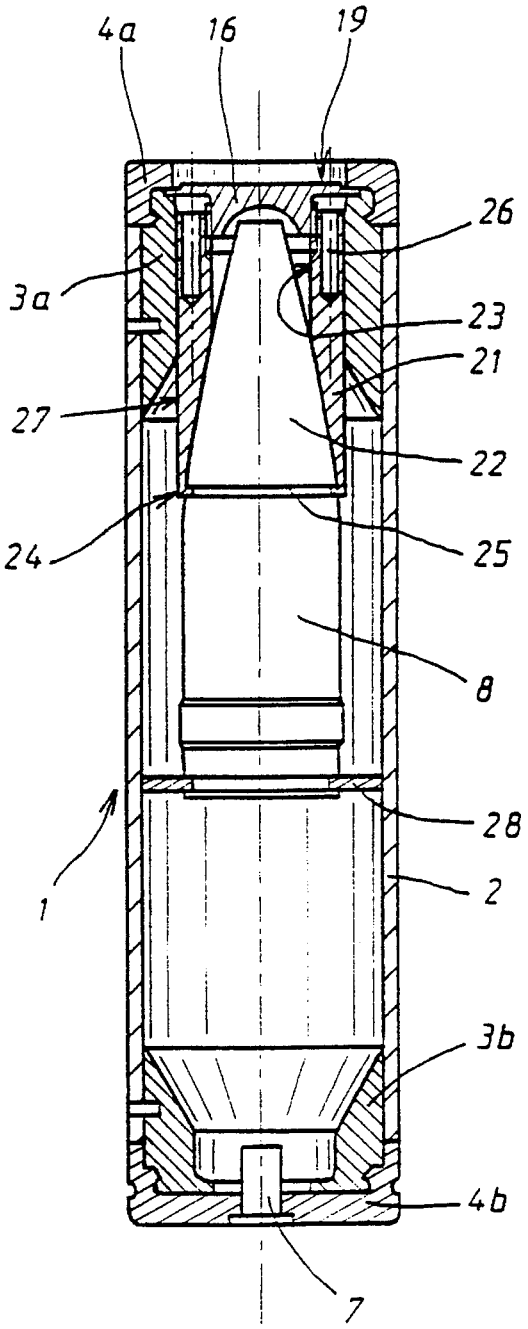
FIG. 4 represents a cross-section of another munition according to the invention wherein the projectile is to caliber.

FIG. 4 shows another munition according to the invention wherein the projectile 8 is of the same caliber as the gun.

The radial holding means of the projectile 8 with respect to the envelope 2 of the munition comprise a nose cone 21, made of plastic material, and which has an internal profile matching the external profile of an ogive 22 of the projectile 8. The internal profile of the nose cone is tipped by a cylindrical boring 23.

The nose cone 21 is made integral with the projectile 8 by means of an edge 24 which is squeezed into a groove 25 fitted on the projectile.

The nose cone 21 comprises drill holes 26 each of an axis parallel to that of the projectile and evenly distributed at an angle. These drill holes are intended to weaken the nose cone thereby enabling it to separate from the projectile by dint of the centrifugal force when exiting from the gun barrel.

The nose cone 21 comprises a cylindrical external profile 27 which enables it to fit in the front plug 3a.

The radial hold of the projectile is completed by a wedge 28 fastened to the rear part of the projectile which also serves as guiding means for the projectile with respect to the envelope 2.

These radial holding means are described in detail in patent FR2647890.

The axial holding means of the projectile 8 with respect to the envelope 2 are provided by a cap 16 which is made integral with the projectile 8 by the nose cone 21.

Figure 5A:
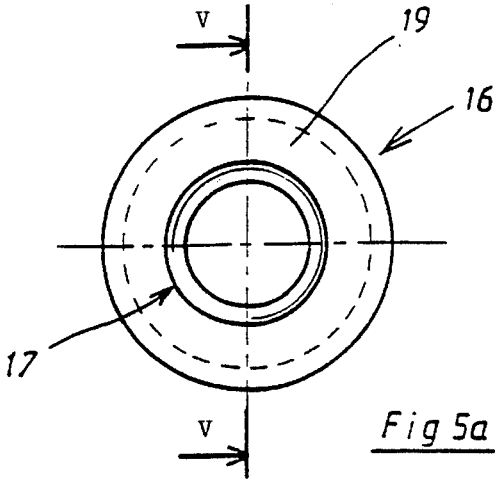
Figure 5B:
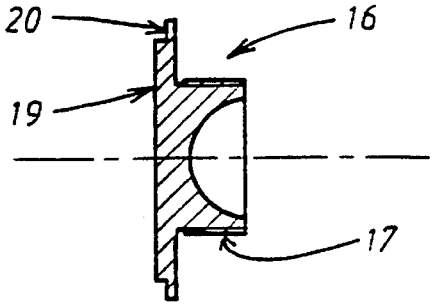

The cap 16 is represented in detail in FIGS. 5a and 5b.

As in the embodiment previously described, the cap 16 comprises a cylindrical central part 17 wherein the diameter is equal to that of a boring 23, and which has been threaded. The cap 16 screws into the threaded boring 23 of the nose cone 21.

The cap 16 also comprises a ring-shaped collar 19 which is designed to be made integral with the plug 3a by fastening means.

According to the particular embodiment here described, the fastening means are composed of the pinching of the collar 19 between the ring 4a and the front plug 3a.

The part of the collar 19 which is pinched is a thinned-off edge 20 which also constitutes a fracture starting point for the collar 19.

Because it is symmetrical with respect to the axis of the munition, the edge 20 fractures when the munition is fired without causing a non-axial shock to the projectile.

The collar 19 also acts as an inner lid for the munition and prevents outside humidity from entering the casing.

The cap in itself ensures the axial hold of the projectile with respect to the front plug 3*a*. It is therefore not necessary to provide a flange for the plug 3*a* or a rear stop for the projectile.

This munition is assembled in the same way as the munition described herebefore with reference to FIGS. 1 and 2.

As a variant the cap may be fastened by means of ultrasonic welding or alternatively by sticking to the material of the front plug.

Figure 6:
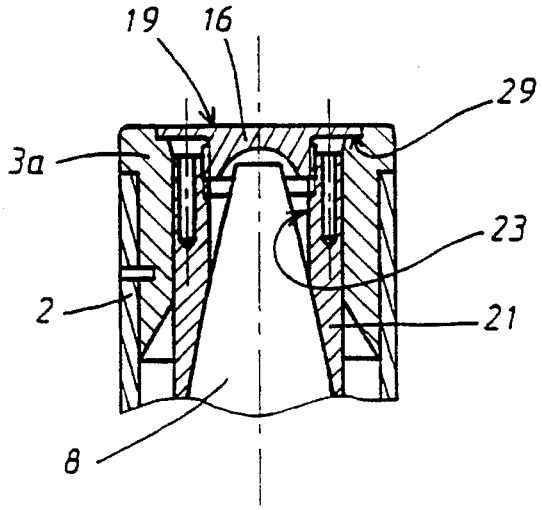
FIG. 6 represents a variant of the embodiment of this munition.

FIG. 6 shows in detail the front part of a munition assembled according to such a variant.

The front plug 3*a* has a counter-sink 29 wherein the collar 19 of the cap 16 is housed.

The cap is fastened to the front plug 3*a* by ultrasonic welding at the countersink 29.

The cap is fastened to the projectile 8 by screwing the threaded cylindrical part 17 of the cap in the boring 23 of the nose cone 21.

Figure 7:
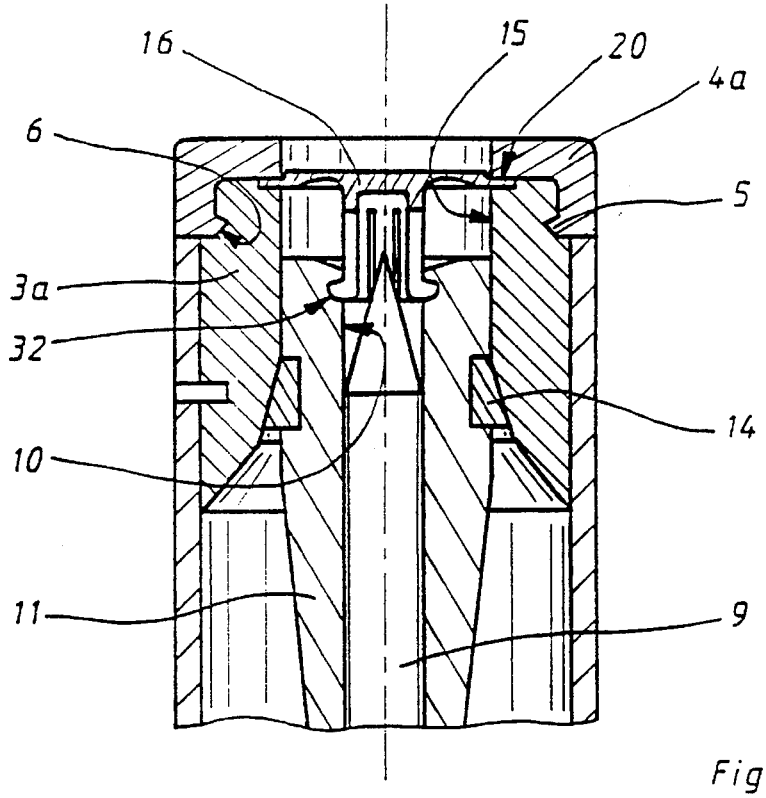
FIG. 7 represents a third embodiment of a munition according to the invention.

FIG. 7 represents a munition according to a third embodiment of the invention.

As for the first embodiment described herebefore with reference to FIGS. 1 and 2, the projectile 8 comprises a sub-caliber shaft 9 placed in a threaded boring 10 or a sabot 11 to caliber.

The axial hold of the projectile 8 with respect to the envelope 2 is provided by a cap 16 integral with the sabot 11 of the projectile.

Figure 8A:
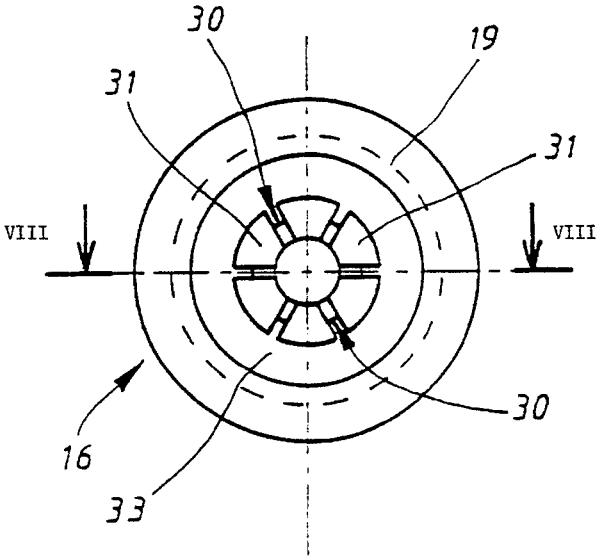
Figure 8B:
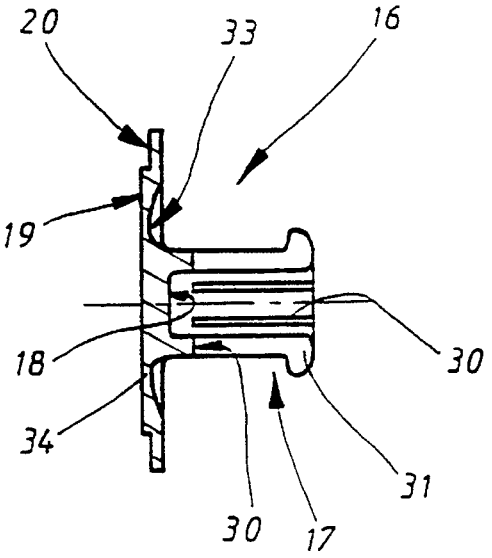

The cap 16 is represented in detail in FIGS. 8*a* and 8*b*. It comprises a cylindrical central part 17 fitted with axial slits 30, evenly distributed at an angle (herein there are six slits).

The end of the central part 17 is fitted with corner-shaped segments 31 which are designed to fit into a groove 32 in the front part of the boring 10 of the sabot 11.

The slits 30 give a certain flexibility to the cylindrical central part 17, which enables the corner-shaped segments 31 to be squeezed into the groove 32.

The cap 16 is therefore made integral with the sabot 11 by means of these segments and the boring 10.

The cap comprises an internal hollow 18 which can house the end of the shaft 9.

As in the previous embodiment, the cap comprises a ring-shaped collar 19, designed to be made integral with the plug 3*a* by fastening means herein constituted by the pinching of the thinned-off edge 20 of the collar 19 between the ring 4*a* and the front plug 3*a*.

The ring-shaped collar 19 also comprises a cone-shaped surface 33 which provides a circular area of reduced thickness 34 wherein the diameter is roughly equal to that of the cylindrical central part 17.

This area of reduced thickness 34 constitutes a fracture starting point whereby its symmetry with respect to the axis of the munition enables it to fracture when the munition is fired without causing a non-axial shock to the projectile.

Connecting the cap 16 by clipping the corner-shaped segments 31 onto the sabot 11 enables the munition to be both quickly and easily mounted onto the plug 3*a*, in the required axial position for the munition, and without straining the belt 14.

Positioning the fracture starting point near to the external diameter of the cylindrical central part 17 facilitates the fragmentation of the cap 16 after firing.

As previously described the collar 19 also acts as an inner lid for the munition and prevents outside humidity from entering the casing.

I claim:

1. A telescoped munition comprising a casing having a cylindrical envelope blocked at front and rear ends with respective front and rear plugs, a projectile in contact with the front plug, said projectile being located within said envelope and between said front and rear plugs, and means to ensure an axial hold of the projectile with respect to the envelope, said axial holding means comprising a cap having a cylindrical central part supporting a front part of the projectile and fitted with a ring-shaped collar connected to the front plug.

2. A munition according to claim 1, wherein the ring-shaped collar seals the front end of the envelope.

3. A munition according to claim 1, further comprising fastening means for fastening the collar to the front plug.

4. A munition according to claim 3, further comprising a reinforcing ring fitted on the front plug, and wherein the fastening means pinches the collar between the reinforcing ring and the front plug.

5. A munition according to claim 1, wherein the cylindrical central part of the cap includes radially evenly distributed axial slits, as well as corner-shaped segments formed on the cylindrical central part of the cap, the corner-shaped segments being inserted in a groove of the projectile.

6. A munition according to claim 1, wherein the ring-shaped collar is structured to fracture about at least one fracture starting point.

7. A munition according to claim 6, wherein the at least one fracture starting point comprises a thinned-off area around the collar, and wherein a diameter of the thinned-off area is substantially equal to that of the cylindrical central part of the cap.

8. A munition according to claim 3, wherein the projectile comprises a sub-caliber shaft placed in a boring of a sabot sized to fit said sub-caliber shaft, and wherein the cap is integral with a front part of the sabot.

9. A munition according to claim 3, wherein the projectile is fitted with an ogive on its front part that receives a nose cone comprising a cylindrical outer profile fittable into the front plug, the nose cone also being fitted with a boring whereby the cap is connected with the projectile.

10. A munition according to claim 3, wherein the fastening means welds the collar onto the front plug.

11. A munition according to claim 8, wherein the boring includes a threaded surface to which the cap is threadedly engaged.

12. A munition according to claim 9, wherein the boring includes threads that are engageable with threads of the cap.

13. A munition according to claim 1, wherein a shape of the cap is symmetrical.

14. A telescoped munition comprising a casing having a cylindrical envelope blocked at front and rear ends with respective front and rear plugs, a projectile in contact with the front plug, said projectile located totally within said envelope and between said front and rear plugs, and means to ensure an axial hold of the projectile with respect to the envelope, said axial holding means comprising a cap closing the front end of the casing, the cap having a cylindrical central part supporting a front part of the projectile and fitted with a ring-shaped collar overlying a front surface portion of the front plug, said ring-shaped collar having a diameter that is larger than an internal diameter of the front plug.

* * * * *